US006134396A

United States Patent [19]

Kaneko

[11] Patent Number: 6,134,396

[45] Date of Patent: Oct. 17, 2000

[54] DEVELOPING APPARATUS

[75] Inventor: Shintaro Kaneko, Ebina, Japan

[73] Assignee: Fuji Xerox Company Ltd., Tokyo, Japan

[21] Appl. No.: 08/965,196

[22] Filed: Nov. 6, 1997

[30] Foreign Application Priority Data

Nov. 8, 1996 [JP] Japan ..... 8-313004

[51] Int. Cl.[7] ..... G03G 15/06

[52] U.S. Cl. ..... 399/55

[58] Field of Search ..... 399/38, 43, 53, 399/55, 119, 222, 235, 252, 258, 270, 27, 37, 79, 88, 61, 285

[56] References Cited

U.S. PATENT DOCUMENTS 5,418,097 5/1995 Furuya et al. ..... 430/42
5,669,050 9/1997 Sakemi et al. ..... 399/270
5,682,572 10/1997 Murai et al. ..... 399/27
5,970,280 10/1999 Suzuki et al. ..... 399/55

FOREIGN PATENT DOCUMENTS 59-38765 3/1984 Japan .
59-184375 10/1984 Japan .

*Primary Examiner*—Arthur T. Grimley
*Assistant Examiner*—William A. Noē
*Attorney, Agent, or Firm*—Oliff & Berridge, PLC

[57] ABSTRACT

A developing apparatus has a developer support 2 to which a developing bias VB with an AC component VAC superimposed on a DC component is applied for visualizing a latent image on a latent image support 1 in a dual component developer G supported on the developer support 2. It includes a use history estimation 5 for estimating a use history of the developer G or a use history detection device 6 for detecting a use history of the developer G and a developing bias power supply 3 provided with a peak-to-peak voltage changing device 4 for changing a peak-to-peak voltage Vp-p of the AC component VAC based on information from the use history estimation device 5 or the use history detection means 6.

6 Claims, 10 Drawing Sheets

DEVELOPING APPARATUS

BACKGROUND OF THE INVENTION

1. Field of the Invention

This invention relates to a developing apparatus for visualizing a latent image on a latent image support in a dual component developer on an electrophotographic copier, an electrophotographic printer, etc., and in particular to an improvement in a developing apparatus of the type wherein a developing bias with an AC component superimposed on a DC component is applied to a developer support.

2. Description of the Related Art

Hitherto, various types of developing apparatuses used with electrophotographic copiers, electrophotographic printers, etc., have been provided; for example, a developing apparatus of the type wherein a developing bias with an AC component superimposed on a DC component is applied between a developer support and a latent image support by using a dual component developer is already known.

In this type, the edge effect (electric force line diffraction from a latent image edge section on the latent image support to a non-image section) can be suppressed by a strong development electric field of the AC component and moreover the developer mobility between the latent image support and the developer support can be improved, so that an electrostatic latent image can be reproduced more faithfully and image quality (reproducibility of a solid part, thin line reproducibility, etc.,) can be improved.

Such a developing apparatus generally adopts a technique of sensing the toner concentration and replenishing with toner if the toner concentration falls below a predetermined level from the viewpoint of providing development.

A conventional development apparatus is already known wherein degradation of a developer is considered and a given print concentration is provided by changing a DC component of a developing bias (for example, refer to Japanese Patent Laid-Open No. Sho 59-38765).

However, if toner concentration control as described above is performed, fluidity of toner changes with time and when the toner fluidity is degraded, a partial transfer failure occurs; a new technical problem is found.

That is, if a developing bias with an AC component superimposed on a DC component is applied to a developer support, a development electric field between the developer support and a latent image support is formed, and toner on the latent image support is close to a closest packing state and is therefore hard to transfer as compared with the situation wherein a developing bias of only AC component is used.

If a developer is used over time under such circumstances, for example, a coating layer of carrier coated with a resin is peeled off, thus the resistance value lowers, resulting in a strong development electric field. On the other hand, the external additive surrounding toner may be peeled off or embedded. Thus, the contact area between toners increases and in addition, toner is placed near the closest packing state under the strong development electric field.

Therefore, if the developer is used with time, the toner fluidity inevitably is degraded, the adhesion force between toners on the latent image support increases, and it becomes difficult to completely transfer the toners onto paper.

A mono component developing apparatus may be used for controlling the effective value of a developing bias (AC component) in response to the remaining amount of a developer in the developing apparatus (for example, refer to Japanese Patent Laid-Open No. Sho 59-184375). This apparatus is provided to solve the problem proper to the mono component developing apparatus, namely, change of development with time associated with the particle diameter of the developer (toner) in the developing apparatus (based on preferential adhesion of toner of small particle diameter to a developer support); it cannot be adopted immediately as technical means for solving the above-described technical problem of the dual component developing apparatus.

SUMMARY OF THE INVENTION

It is therefore an object of the invention to provide a developing apparatus adapted to efficiently prevent a transfer failure associated with change of a developer with time, a problem proper to a dual component developing apparatus using a developing bias with an AC component piggybacked on a DC component, for effectively prolonging the use life of the developer.

To this end, according to one aspect of the invention, there is provided a developing apparatus having a developer support to which a developing bias with an AC component piggybacked on a DC component is applied for visualizing a latent image on a latent image support in a dual component developer supported on the developer support, characterized by use history estimation means for estimating a use history of the developer, and a developing bias power supply being provided with peak-to-peak voltage changing means for changing a peak-to-peak voltage Vp-p of the AC component VAC based on information from the use history estimation means.

According to another aspect of the invention, there is provided a developing apparatus having a developer support to which a developing bias with an AC component superimposed on a DC component is applied for visualizing a latent image on a latent image support in a dual component developer supported on the developer support, characterized by use history detection means for detecting a use history of the developer, and a developing bias power supply being provided with peak-to-peak voltage changing means for changing a peak-to-peak voltage Vp-p of the AC component based on information from the use history detection means.

In such technical means, the dual component developer may come in sliding contact with the surface of the latent image support or may come in no contact therewith for jumping developing. The average particle diameter of toner of the dual component developer and the AC component frequency of the developing bias may be determined appropriately in response to developing parameters and the developer type.

Further, the AC component of the developing bias may contain one frequency component or may consist of two frequency components, and the waveform of the AC component may be selected appropriately from among a sine wave, a rectangular wave, a sawtooth wave, and the like.

The use history estimation means may be any means selected appropriately that uses information corresponding to a developer use history, the number of image formation times, charge characteristic change of the latent image support, and the like. Furthermore the number of developing times and the developing time can be used as the information corresponding to a developer use history.

Further, the use history detection means may be any means that is a functional means for directly detecting a developer use history, such as means for detecting the toner charge characteristic of a developer or a carrier resistance change.

The peak-to-peak voltage changing means may be adapted to change the peak-to-peak voltage from the maximum initial value to zero continuously or step by step or may be adapted to change the peak-to-peak voltage from the maximum initial value to a predetermined lower limit value (not zero) continuously or step by step. For the maximum initial value of the peak-to-peak voltage and a peak-to-peak voltage change pattern, optimum values are selected from the developing parameters and the developer characteristics.

In the form wherein the AC component has two frequency components, the peak-to-peak voltage changing means may be adapted to change the peak-to-peak voltage Vp-p of either of the frequency components or the peak-to-peak voltages Vp-p of both the frequency components at the same time.

Next, the function of the above respective means will be discussed.

The peak-to-peak voltage changing means changes the peak-to-peak voltage of the AC component based on the information from the use history estimation means or the use history detection means.

At this time, the relationship between the information from the use history estimation means or the use history detection means and the peak-to-peak voltage Vp-p of the AC component may have been previously adjusted, for example, when the developer changes with time. Then the peak-to-peak voltage of the AC component is decreased appropriately, whereby toner developing is enabled without increasing the adhesion force between toners developed on the latent image support more than necessary.

The above and other objects and features of the present invention will be more apparent from the following description taken in conjunction with the accompanying drawings.

DETAILED DESCRIPTION OF THE PREFERRED EMBODIMENTS

Now, a description will be given in more detail of preferred embodiments with reference to the accompanying drawings.

Figure 1:
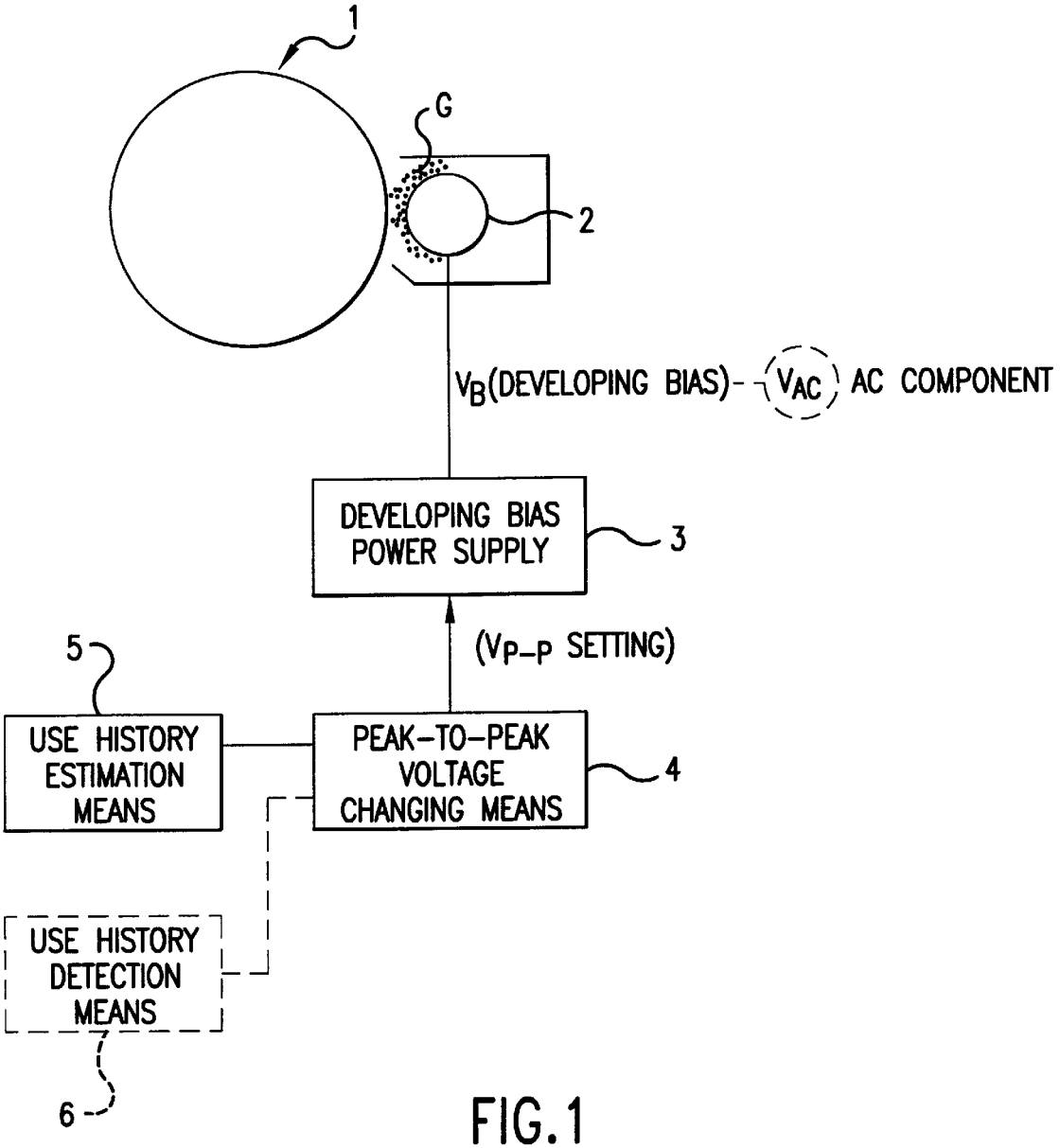
FIG. 1 is an illustration to show the configuration of a developing apparatus according to the invention.

FIG. 1 is an exemplary diagram according to one aspect of the invention. FIG. 1 illustrates a developing apparatus having a developer support to which a developing bias with an AC component piggybacked on a DC component is applied for visualizing a latent image on a latent image support 1 in a dual component developer G supported on the developer support 2, characterized by use history estimation means 5 for estimating a use history of the developer G, and a developing bias power supply 3 being provided with peak-to-peak voltage changing means 4 for changing a peak-to-peak voltage Vp-p of the AC component VAC based on information from the use history estimation means 5.

According to another aspect of the invention, FIG. 1 illustrates a developing apparatus having a developer support 2 to which a developing bias with an AC component piggybacked on a DC component is applied for visualizing a latent image on a latent image support 1 in a dually component developer G supported on the developer support 2, characterized by use history detection means 6 for detecting a use history of the developer, and a developing bias power supply 3 being provided with peak-to-peak voltage changing means 4 for changing a peak-to-peak voltage Vp-p of the AC component based on information from the use history detection means 6.

(First Embodiment)

Figure 2:
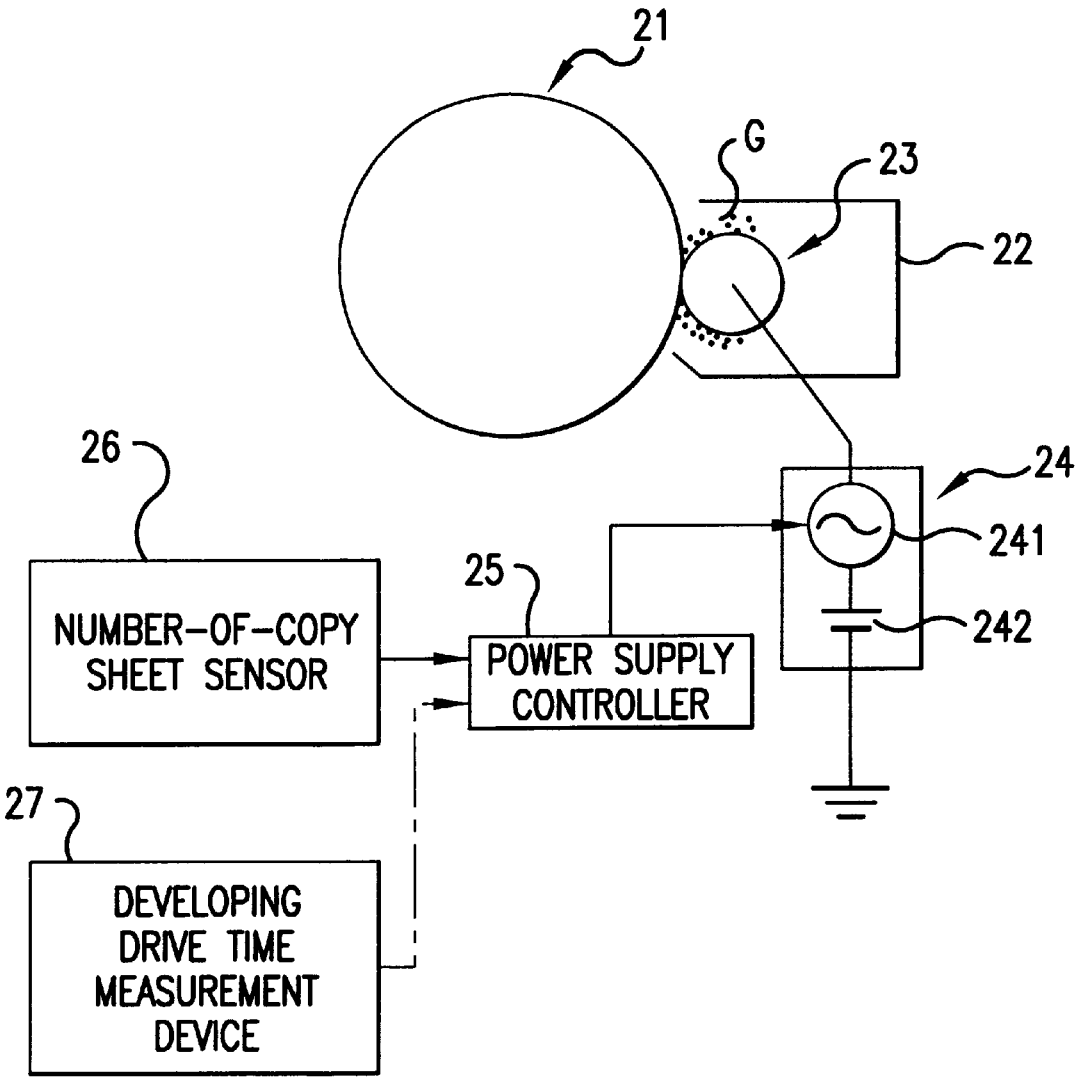
FIG. 2 is an illustration to show an outlined configuration of a developing apparatus according to a first embodiment of the invention.

FIG. 2 shows an outlined configuration of a first embodiment of a developing apparatus to which the invention is applied.

The developing apparatus has a development housing 22 opened facing a latent image support 21 of a photosensitive drum, etc. Dual component developer G is housed in the development housing 22 and a developing roll 23 (for example, a fixed magnet having a predetermined number of magnetic poles arranged in a non-magnetic conductive developing sleeve) disposed at a position facing the opening of the development housing 22.

A developing bias from a developing bias power supply 24 is applied to the surface of the developing roll 23 of the developing apparatus (surface of the developing sleeve).

In the embodiment, the developing bias power supply 24 comprises an AC voltage power supply 241 and a DC voltage power supply 242 placed in series, and the development bias comprises an AC component superimposed on a DC component.

Further, in the embodiment, a power supply controller 25 is connected to the developing bias power supply 24. It is adapted to change and set the peak-to-peak voltage of the AC component of the developing bias in response to the number of copy sheets from a number-of-copy-sheet sensor 26.

Figure 3:
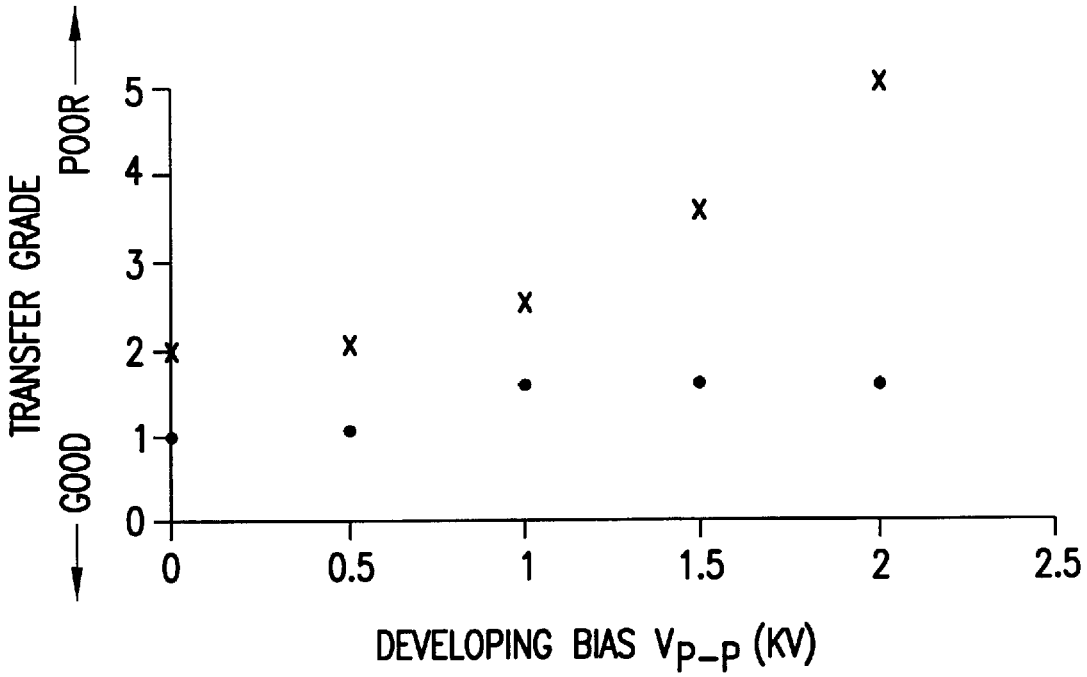
FIG. 3 is a graph to show the relationship between developing bias Vp-p and transfer grade for a new developer and a degraded developer.

To determine the degree of changing the peak-to-peak voltage of the AC component, the following experiment is carried out:

First, the relationship between the peak-to-peak voltage Vp-p of the AC component (in the experiment, sine wave 6 kHz is used) and transfer grade (determined by visual inspection of the mottle degree when a solid image is transferred; 3 or less as target figure) is examined. As seen in FIG. 3, for a new developer (in the figure), the transfer grade is held good if the peak-to-peak voltage Vp-p of the AC component is set large; for a degraded developer (X in the figure), the transfer grade extremely lowers if the peak-to-peak voltage Vp-p of the AC component is large.

Figure 4:
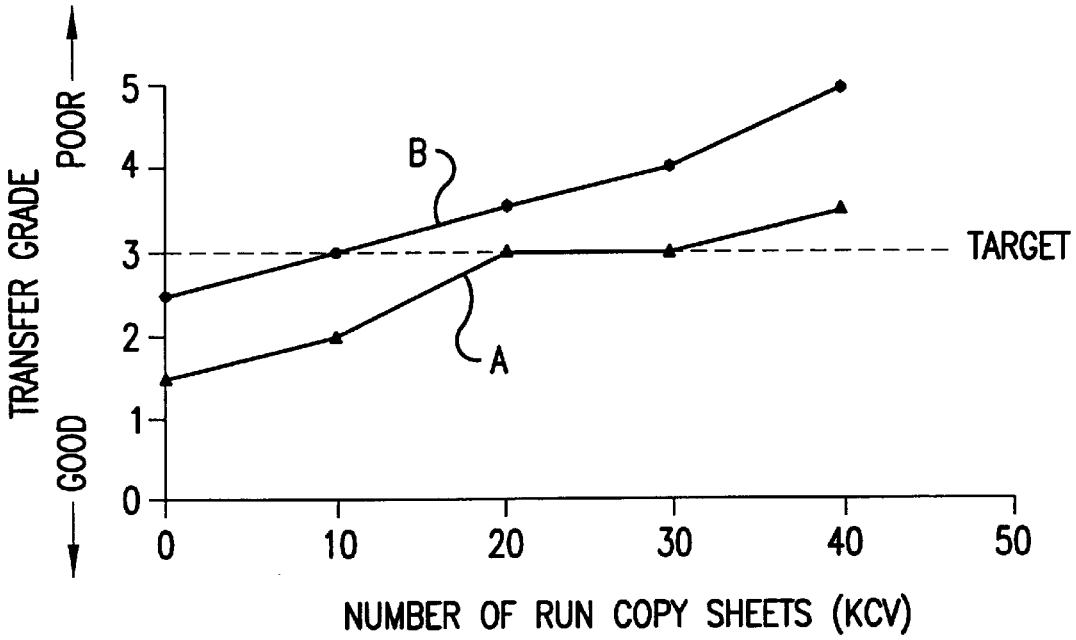
FIG. 4 is a graph to show the relationship between the number of run copy sheets and transfer grade for paper A and paper B in the first embodiment of the invention.

The relationship between the number of run copy sheets (kCV:×1000 sheets) and transfer grade (3 or less as target figure) is also examined. As seen in FIG. 4, as the number of run copy sheets increases, the transfer grade worsens regardless of copy paper A (for example, color paper) or B (for example, cardboard).

Based on the experiment results, the peak-to-peak voltage Vp-p of the AC component may be determined so that the transfer grade falls under 3 or less in response to the number of run copy sheets of copy paper used.

Figure 5:
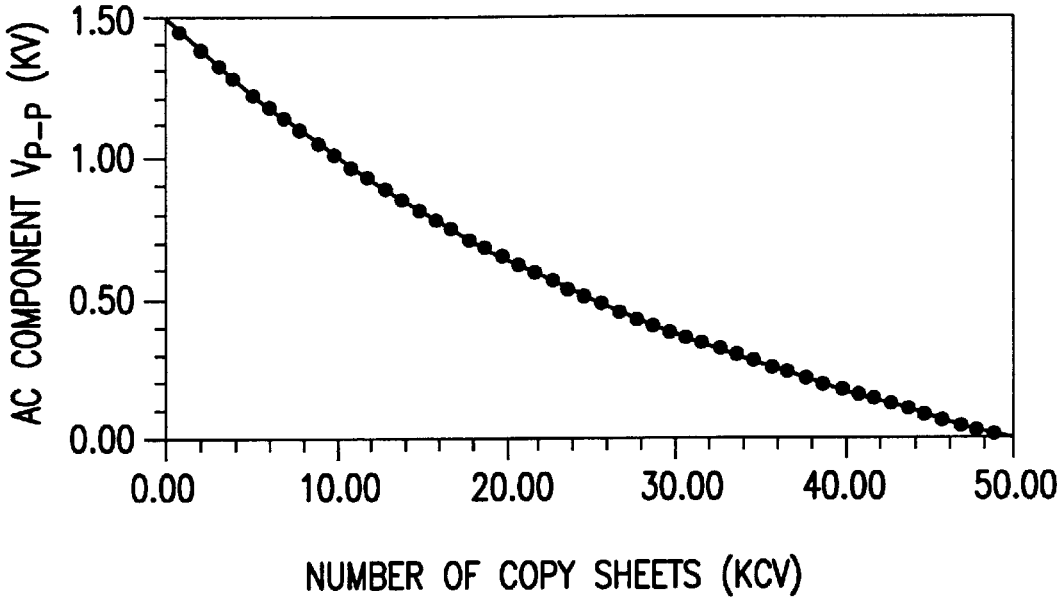
FIG. 5 is a graph to show the operation of a power supply controller used with the first embodiment of the invention.

In the embodiment, when the developer life viewed from electric charge is set to 50,000 copy sheets and the maximum initial value of the peak-to-peak voltage Vp-p is set to 1.50 kV, the peak-to-peak voltage Vp-p of the AC component relative to the number of run copy sheets is set as:

Vp-p=1.5 kV×(50,000−number of copy sheets)/(number of copy sheets+50,000). FIG. 5 shows the change pattern.

Figure 6:
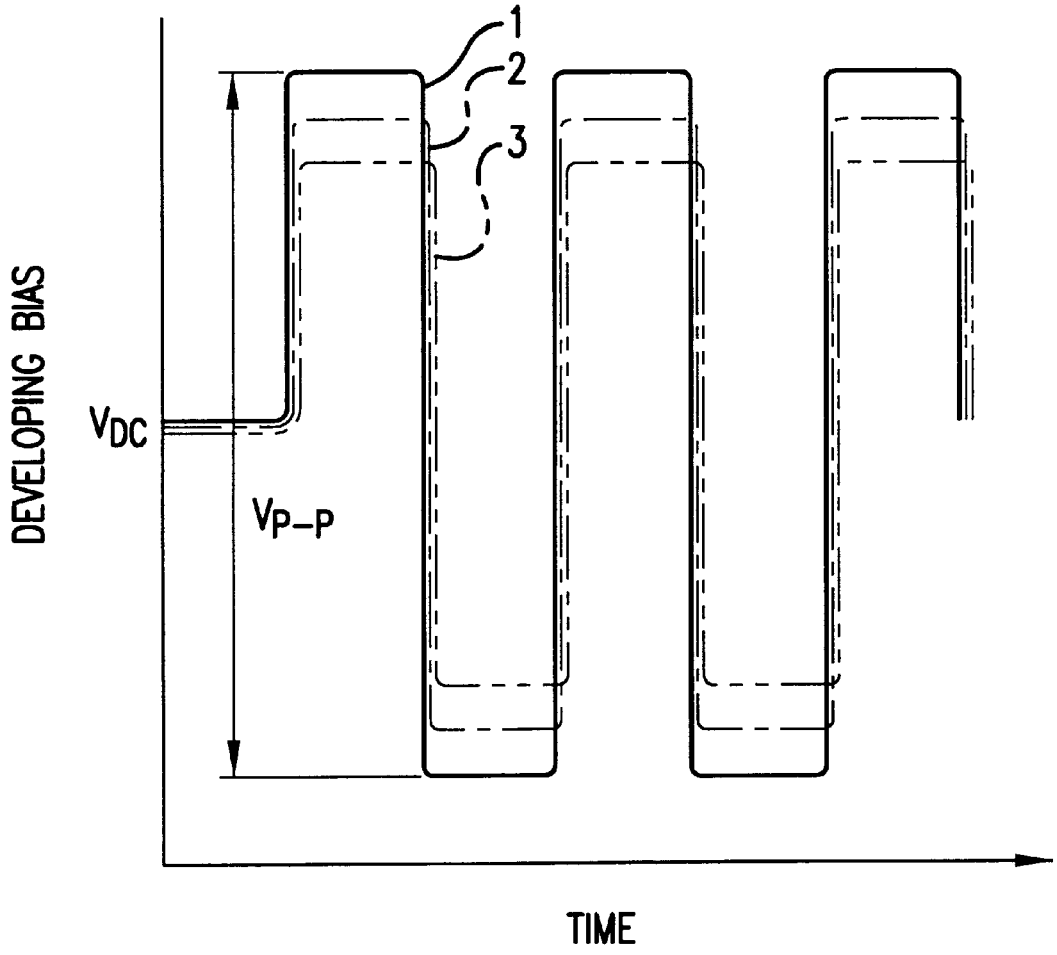
FIG. 6 is a graph to show a developing bias change pattern according to the first embodiment of the invention.

In this case, as the number of run copy sheets increases, the peak-to-peak voltage Vp-p of the AC component gradually decreases although the DC component VDC of the developing bias is constant, as shown in (1)→(2)→(3) in FIG. 6.

When the power supply controller 25 thus controls the peak-to-peak voltage Vp-p of the AC component, images of good transfer grade can be provided up to 50,000 run copy sheets.

In the embodiment, the number-of-copy-sheet sensor 26 senses the number of run copy sheets and a developer use history is estimated. For example, a developing drive time measurement device 27 for measuring the operation time of the developing roll 23, etc., may be used to estimate a developer use history, as indicated by phantom lines in FIG. 2.

(Second Embodiment)

A developing apparatus according to a second embodiment of the invention has a basic configuration similar to that of the first embodiment except that a change pattern of the peak-to-peak voltage of the AC component by a power supply controller 25 is set to a pattern different from that in the first embodiment.

Figure 7:
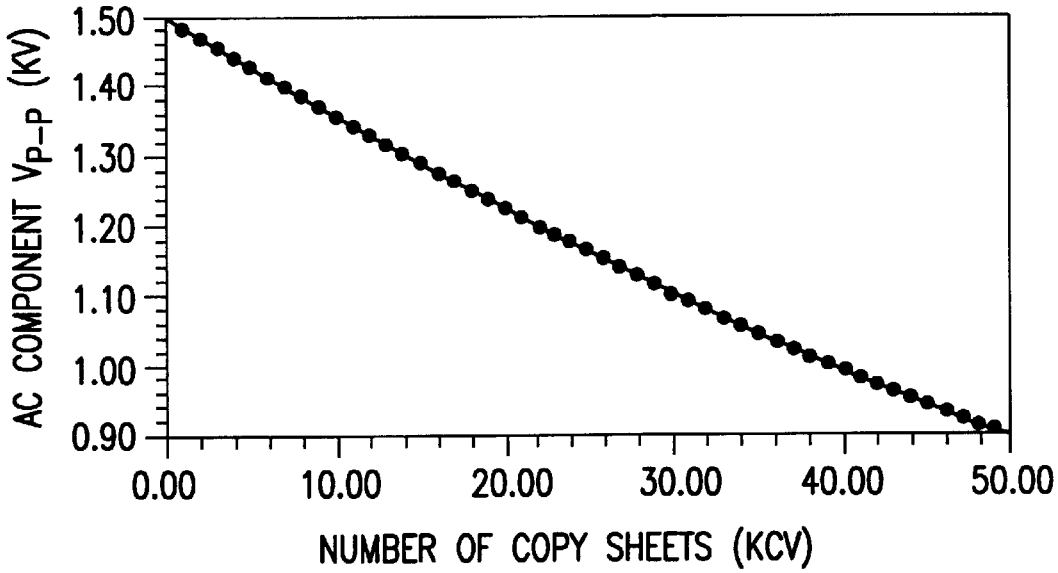
FIG. 7 is a graph to show the operation of a power supply controller used with a second embodiment of the invention.

That is, in the second embodiment, when the developer life viewed from electric charge is set to 50,000 copy sheets and the maximum initial value of the peak-to-peak voltage Vp-p is set to 1.50 kV, the peak-to-peak voltage Vp-p of the AC component relative to the number of run copy sheets is set as:

Vp-p=1.5 kV×(200,000−number of copy sheets)/(number of copy sheets+200,000). FIG. 7 shows the change pattern.

In the embodiment, if the number of run copy sheets is 50,000, the AC component of the peak-to-peak voltage Vp-p, 0.9 kV is applied. Thus, for example, for a less degraded developer, a priority can also be given to improvement of image reproducibility by applying the AC component.

(Third Embodiment)

Figure 8:
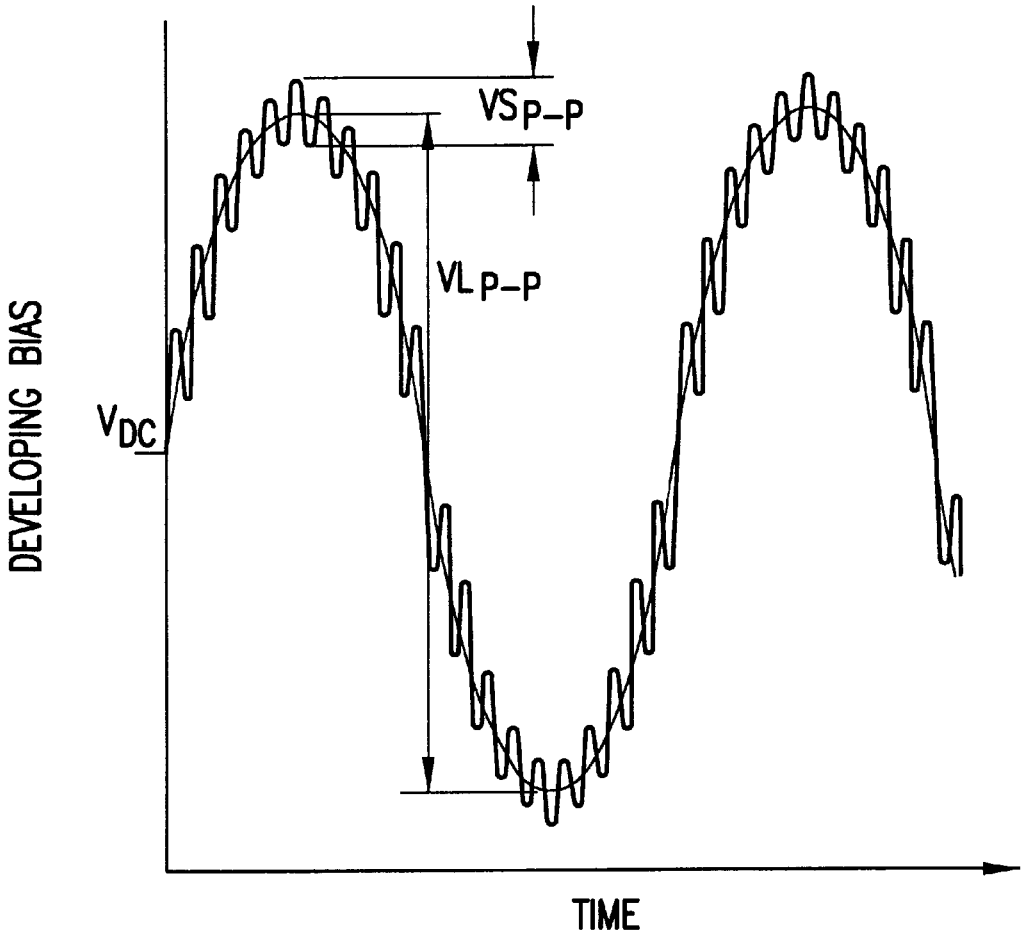
FIG. 8 is an illustration to show the control contents for a developing bias of a developing apparatus according to a third embodiment of the invention.

A developing apparatus according to a third embodiment of the invention has a basic configuration similar to that of the first embodiment except that the AC component of a developing bias has two types of frequency components (low frequency component and high frequency component), as shown in FIG. 8.

In the third embodiment, a power supply controller 25 may be responsive to the number of run copy sheets or the developing drive time for changing peak-to-peak voltage VSp-p of the high frequency component (ripple component) of the AC component, peak-to-peak voltage VLp-p of the low frequency component of the AC component, or both the peak-to-peak voltages at the same time. In FIG. 8, VDC denotes the DC component of the developing bias.

(Fourth Embodiment)

Figure 9:
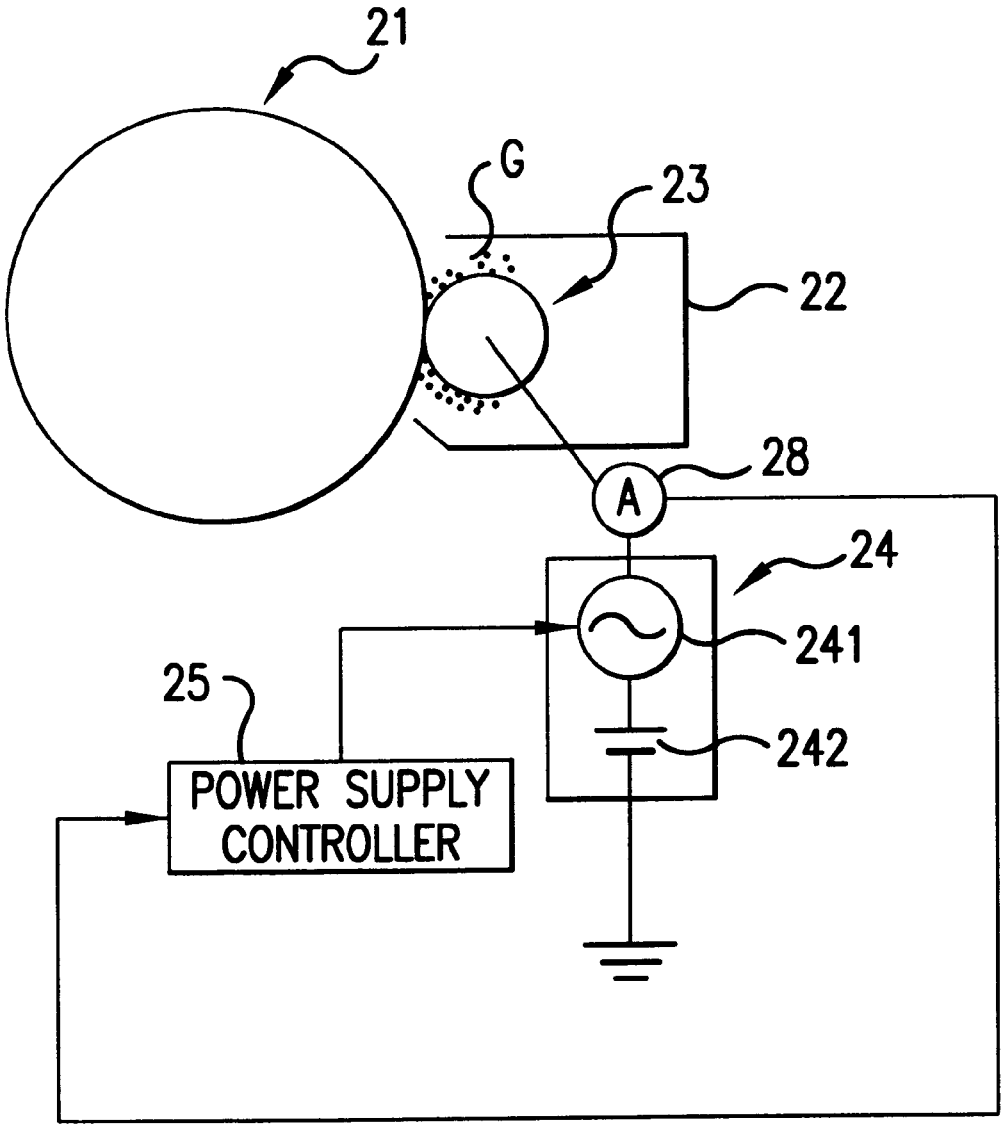
FIG. 9 is an illustration to show an outlined configuration of a developing apparatus according to a fourth embodiment of the invention.

FIG. 9 shows an outlined configuration of a fourth embodiment of a developing apparatus to which the invention is applied.

The developing apparatus according to the fourth embodiment of the invention shown in FIG. 9 has a basic configuration similar to that of the first embodiment except that it comprises an ampere meter 28 placed in series with a developing roll 23 and a developing bias power supply 24 for measuring one bias supply current to the developer, thereby measuring the resistance value of the developer changing with time. Thus, the actual use state also containing the environment, etc., can be furthermore grasped. Substantially, based on current change in the ampere meter 28, a power supply controller 25 is controlled for changing and setting the peak-to-peak voltage of an AC component of a developing bias. Parts similar to those previously described with reference to FIG. 2 are denoted by the same reference numerals in FIG. 9 and will not be discussed again in detail. It also may be effective to change the frequency of the AC component of the developing bias. This means that it is effective to raise the frequency of the peak-to-peak voltage in response to the resistance value of the developer.

Figure 10A:
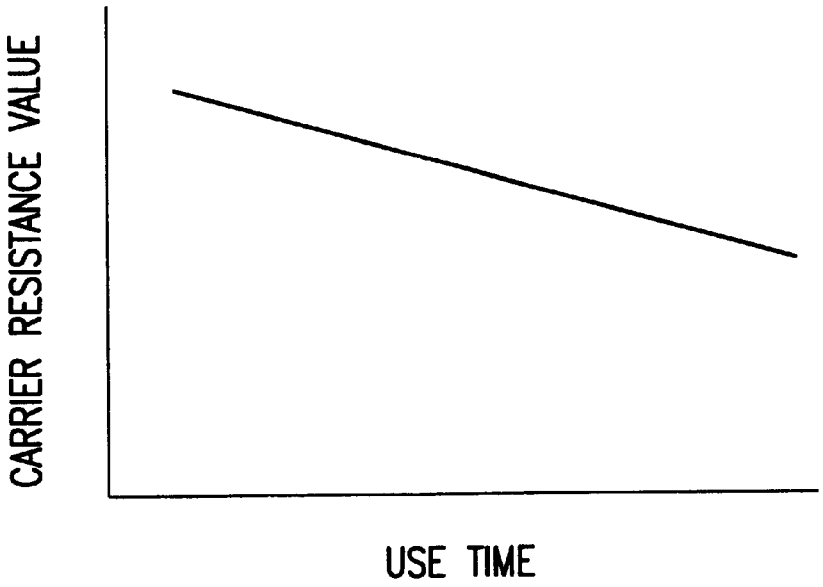
FIG. 10A is a graph to show the relationship between the use time and carrier resistance value.
Figure 10B:
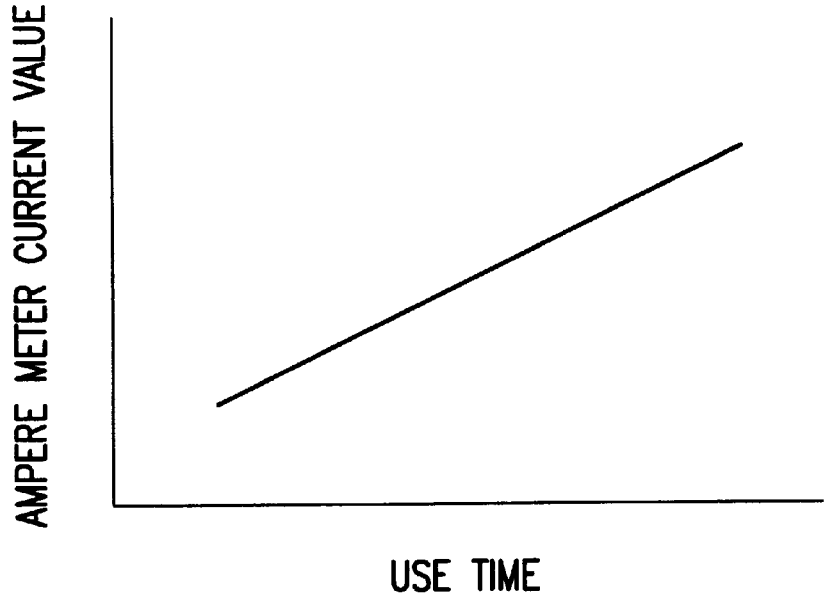
FIG. 10B is a graph to show the relationship between the use time and ampere meter current value.

In the embodiment, when the developer is used with time, the carrier resistance value of the developer lowers gradually with the use time, as shown in FIG. 10(*a*). Thus, the current value of the ampere meter 28 in the embodiment tends to decrease gradually with the use time, as shown in FIG. 10(*b*).

At this time, the current value of the ampere meter 28 is monitored, whereby a developer use history (degradation degree) can be determined. Thus, if the peak-to-peak voltage of the AC component controlled by the power supply controller 25 is set appropriately based on the current value of the ampere meter 28 (developer use history), it is made possible to apply the developing bias responsive to the developer use history, and images of good transfer grade can be provided up to the developer use life (for example, 50,000 run copy sheets).

Particularly, as compared with the first to third embodiments, the development apparatus of the fourth embodiment directly detects a developer use history, so that the peak-to-peak voltage of the AC component can be controlled more precisely in response to the developer use history.

As we have discussed, according to the invention, the dual component developing apparatus using the developing bias with an AC component superimposed on a DC component estimates or detects a use history of a developer, changes the peak-to-peak voltage of the AC component in response to the developer use history, and performs toner developing without increasing the adhesion force between toners developed on the latent image support more than necessary. Thus, the apparatus can avoid an increase in the toner adhesion force based on toner fluidity degradation and carrier resistance value lowering associated with change of the developer with time and can effectively prevent a transfer failure caused by an increase in the toner adhesion force.

Thus, the transfer failure caused by change of the developer with time can be corrected and an optimum toner layer from the transfer property can always be formed.

Therefore, for the image quality mainly based on the transfer property, the state when the developer is not degraded can be substantially held; the developer use life can be prolonged efficiently and the number of developer replacement times associated with the transfer failure can be reduced.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

a latent image support;

a developer support to which a developing bias with an AC component superimposed on a DC component is applied for visualizing a latent image on said latent image support using a dual component developer supported on said developer support;

a resistance measuring device that measures a carrier resistance of the developer;

a developing bias power supply; and peak-to-peak voltage changing means provided in said developing bias power supply for reducing a peak-to-peak voltage of the AC component gradually based on a reduction of the carrier resistance.

2. An image forming apparatus as claimed in claim 1 wherein the AC component has at least two frequency components; and wherein said peak-to-peak voltage changing means changes the peak-to-peak voltage of at least one of the two frequency components.

3. An image forming apparatus, comprising:

a latent image support;

a developer support to which a developing bias with an AC component superimposed on a DC component is applied for visualizing a latent image on said latent image support using developer supported on said developer support;

a developer bias power supply;

a current measuring means for measuring an increase in a current value of the developer with time; and peak-to-peak voltage changing means provided in said developing bias power supply for reducing a peak-to-peak voltage of the AC component gradually based on the increase in a current value information from a use history detection means.

4. An image forming apparatus as claimed in claim 3 wherein the AC component has at least two frequency components; and wherein said peak-to-peak voltage changing means changes the peak-to-peak voltage of at least one of the two frequency components.

5. An image forming apparatus, comprising:

a latent image support;

a developer support to which a developing bias with an AC component piggybacked on a DC component is applied for visualizing a latent image on said latent image support in a dual component developer supported on said developer support a resistance measurement means for measuring a resistance value of said developer between said latent image support and said developer support; and a developing bias power supply; and peak-to-peak voltage changing means responsive to the number of run copy sheets provided in said developing bias power supply for changing a peak-to-peak voltage of an AC component based on information from said resistance measurement means.

6. An image forming apparatus, comprising:

a latent image support;

a developer support to which a developing bias with an AC component superimposed on a DC component is applied for visualizing a latent image on said latent image support using a dual component developer supported on said developer support;

a measurement means for measuring a number of copy sheets since a use start time of a new developer;

a developing bias power supply; and peak-to-peak voltage changing means provided in said developing bias power supply for reducing a peak-to-peak voltage of the AC component gradually based on an increase of the number of copy sheets.

* * * * *